US006848236B2

(12) United States Patent
Eder

(10) Patent No.: US 6,848,236 B2
(45) Date of Patent: Feb. 1, 2005

(54) MACHINE PROTECTION DEVICE

(76) Inventor: Erich Eder, Goethestrasse 6, D-93093 Donaustauf (DE)

( * ) Notice: Subject to any disclaimer, the term of this patent is extended or adjusted under 35 U.S.C. 154(b) by 97 days.

(21) Appl. No.: 10/312,234

(22) PCT Filed: Oct. 16, 2001

(86) PCT No.: PCT/EP01/11920

§ 371 (c)(1),
(2), (4) Date: Dec. 23, 2002

(87) PCT Pub. No.: WO02/36480

PCT Pub. Date: May 10, 2002

(65) Prior Publication Data

US 2004/0103617 A1 Jun. 3, 2004

(30) Foreign Application Priority Data

Nov. 4, 2000 (DE) ..... 200 18 840 U

(51) Int. Cl.[7] ..... B65B 57/00

(52) U.S. Cl. ..... 53/393; 52/65; 52/239; 53/266.1; 53/167; 181/200; 256/24

(58) Field of Search ..... 53/393, 425, 426, 53/167, 235, 266.1; 52/65, 239; 160/135, 351; 181/200; 256/24

(56) References Cited

U.S. PATENT DOCUMENTS 4,606,394 A * 8/1986 Bannister ..... 160/351
5,447,002 A * 9/1995 Wehrman ..... 52/239
D372,487 S * 8/1996 Brewer et al. ..... D15/145

FOREIGN PATENT DOCUMENTS

| | | | | |
|---|---|---|---|---|
| DE | 3029755 | | 3/1982 | |
| DE | 29809791 | | 10/1998 | |
| EP | 0011554 | A * | 5/1980 | ..... B23Q/11/08 |
| EP | 0305652 | A * | 3/1989 | ..... B67C/1/00 |
| EP | 870880 | | 10/1998 | |
| FR | 2 429 374 | | 1/1980 | |

OTHER PUBLICATIONS

Krones Magazine, Edition Feb. 2000, pp. 42–45, issued by the Executive Board of Krones AG, D–93068 Neutraubling, Germany.

* cited by examiner

*Primary Examiner*—Stephen F. Gerrity
(74) *Attorney, Agent, or Firm*—Marshall, Gerstein & Borun LLP

(57) ABSTRACT

A treatment or manufacturing installation in a working area, comprising at least one machine having at least one workstation, particularly a beverage bottle treatment or manufacturing machine, which is fixedly disposed on a floor area, and comprising a machine protection device which comprises panes which cover at least the workstation in a supporting frame which comprises vertical pillars and which defines an area.

20 Claims, 5 Drawing Sheets

MACHINE PROTECTION DEVICE

RELATED APPLICATION DATA

This disclosure claims the benefit of the filing date of International Application PCT/EP01/11920, having an international filing date of Oct. 16, 2001, which designated the United States of America, and this disclosure is the United States national stage of that international application. This disclosure further claims priority to German patent application 200 18 840.2 filed on Nov. 4, 2000.

FIELD OF THE INVENTION

This invention relates to a treatment or manufacturing installation as a clean room-type machine protection device such as for use in beverage bottling operations.

BACKGROUND OF THE INVENTION

In a bottle treatment machine according to DE 30 29 755 A, the supporting framework of the machine protection device is placed on the machine frame in order to provide external screening of the work stations which are disposed above the machine frame. Height adjustable panes, which consist of a transparent plastics material, are disposed in the areas. Each pane has an upper and lower edge flange which is integral therewith and which faces inwards, and comprises angle sections which extend vertically on the inner faces of the panes and which serve for stiffening, and to which holding devices are fixed. Rollers on the holding devices fit into tracks defined by the vertical pillars. This arrangement represents a conventional design of a machine protection device which is integrated in the installation.

A design for a bottle filling installation is known from the KRONES Magazine, Edition 2/2000, issued by the Executive Board of KRONES AG, D-93068 Neutraubling DE, the assignee of the present invention, at pages 42 to 45, according to which the filling installation is additionally disposed, together with an integrated, completely encapsulated machine protection device, inside a clean room delimited by a supporting frame structure which comprises internal panes and which is fixed between the floor area and the ceiling in the working area. The supporting frame delimits a frame area which does not follow the floor area contour of the installation but which separates the installation from other, free-standing installation regions in the working area, and which is also at a considerable distance from the installation so as to prevent the panes from being contaminated by the installation.

Due to its framed panes, seals, fittings and frame structure, a fully integrated machine protection device tends to exhibit regions of acute contamination which can only be kept clean or cleaned with difficulty. Furthermore, it impedes access, of course, to certain parts of the work stations, and restricts the field of view. If the installation is operated under isolated or clean room conditions, then external screening of the clean room area is required despite the encapsulating machine protection device, which implies a considerable cost of construction.

SUMMARY OF THE INVENTION

The underlying object of the present invention is to provide a treatment or manufacturing installation in a working area, and is also to provide a machine protection device, with which the aforementioned disadvantages are avoided, and with which a machine protection function, and if necessary a clean room isolation function also, can be achieved at a justifiable cost of construction.

In this treatment or manufacturing installation in a working area, the supporting frame, with the safety glass panes which are anchored in a frameless manner therein, functions both as a machine protection device and as a room screen. For this combination of functions, the panes have to be frameless safety glass panes which comply with the requisite safety standards and which, by virtue of their pane inner faces which are exposed as far as the pane edges, can be cleaned without problems and can be kept clean without problems, in order to comply with hygiene requirements which extend as far as clean room requirements. There is an almost continuous area of safety glass facing the machine, whilst the bulk of the fittings and of the vertical pillars which comprise additional fittings are disposed outside the screened room area. The supporting frame can be of relatively slender construction, and by virtue of its arrangement and construction it is autonomously stable. It important that the supporting frame is matched to the floor area contour of the machine or at least substantially follows the contour thereof, and that both functions are thereby reliably performed. The clean room is only just as large as necessary, and can therefore be operated in an energy-saving manner.

The short distance to the floor area contour of the machines is advantageous for the machine protection function, i.e. for sound insulation, protection from spray, protection from damage and the like.

The machine protection device also performs a dual function if it is only matched to the floor area contour of the machine as a screen for a clean room area without integration in the machine, and if it is designed in an adaptable modular mode of construction. The frameless safety glass panes permit stable integration of the panes in the supporting frame. This is also important with regard to maintaining cleanliness, which due to the elimination of an integrated machine protection device is more crucial than is a room screening function of a machine or installation which already comprises an integrated machine protection device.

A single, frameless safety glass pane is advantageously fixedly anchored for each non-opening area, and one or two safety glass panes are advantageously anchored so that they can swivel for each opening area, in order to make the requisite access possible in a convenient manner, or even to form a lock or the like, if necessary.

Open gaps should be present between adjacent vertical pane edges in order to permit a defined, limited exchange of air with an outward direction of flow, and to permit simple, effective cleaning of the pane edges also. Furthermore, manufacturing tolerances, individual movements of the areas, and dimensional changes due to thermal effects can be compensated for in the gaps without problems.

The stability of the supporting frame is improved by strip-like sheet metal screens between the vertical pillars above the safety glass panes. Moreover, the sheet metal screens can conveniently be employed as supports for additional fittings. Sheet metal screens which consist of rust-proof stainless steel are easy to keep clean, and contribute to a pleasing visual impression. Furthermore, a screen reduces the requisite height of the safety glass panes.

The height-adjustable standing feet on the vertical pillars enable the supporting frame to be adjusted accurately. The outward offset of the standing feet is advantageous with regard to the cleanliness of the outer edge of the clean room area. The lower pane edges form drip-off edges from which contaminants fall on to the standing foot without contaminating the stands.

Moreover, due to the offset of the standing feet, the drip-off region can easily be kept clean.

Lower transverse struts are also advantageous between the vertical pillars in areas which comprise fixedly anchored panes, in order to increase the stability and intrinsic rigidity of the supporting frame.

Operationally reliable pane edge clamping fittings and pane edge contact supports hold the fixedly anchored safety glass panes and are advantageous with regard to maintaining cleanliness.

The safety glass panes which can be swivelled are anchored by rotary clamping fittings which also fit positively into the panes. These fittings can also easily be cleaned on the inside of the clean room area.

Internal and/or external mountings for additional upper fitting parts can be provided on the screens between the vertical pillars.

It is advantageous if sheet metal panels with corresponding openings are incorporated in the supporting frame in regions in which passageways are required from the outside into the clean room area or from the inside to the outside.

Even though the supporting frame is autonomously stable and performs its machine protection function and clean room function without any direct connection to the machine, it may be advantageous in some situations to provide spacers between the vertical pillars and the machine.

With regard to effective cleaning, stable positioning and ease of installation of the panes, the contact supports should comprise only one pin, as well as inner and outer holding brackets which each act inwards from the edge of a pane.

The requisite stability of the supporting frame is achieved by means of areas which are at least substantially at right angles to each other, in cooperation with the transverse connections between the vertical pillars, wherein a plurality of rectilinearly aligned areas can be provided between the angles in each case. Identical or different area widths are advantageous in order to adapt each supporting frame to the floor area contour of the machine or to the working areas which are necessary for working on the machine. The supporting frame can optionally be cut to size, converted or modified in the manner of a construction kit to suit the installation concerned. It is assembled like a construction kit from only a few individual parts which can be freely combined with each other according to choice.

The safety glass panes are advantageously exposed at a distance in front of the inner faces of the vertical pillars, in what is an unsupported manner, so as not only to be able to clean the safety glass panes thoroughly on the inside, but also to avoid particular zones which are susceptible to contamination in the clean room area.

BRIEF DESCRIPTION OF THE DRAWINGS

Examples of embodiments of the subject matter of the invention are explained below with reference to the drawings, where.

DETAILED DESCRIPTION OF THE INVENTION

Figure 1:
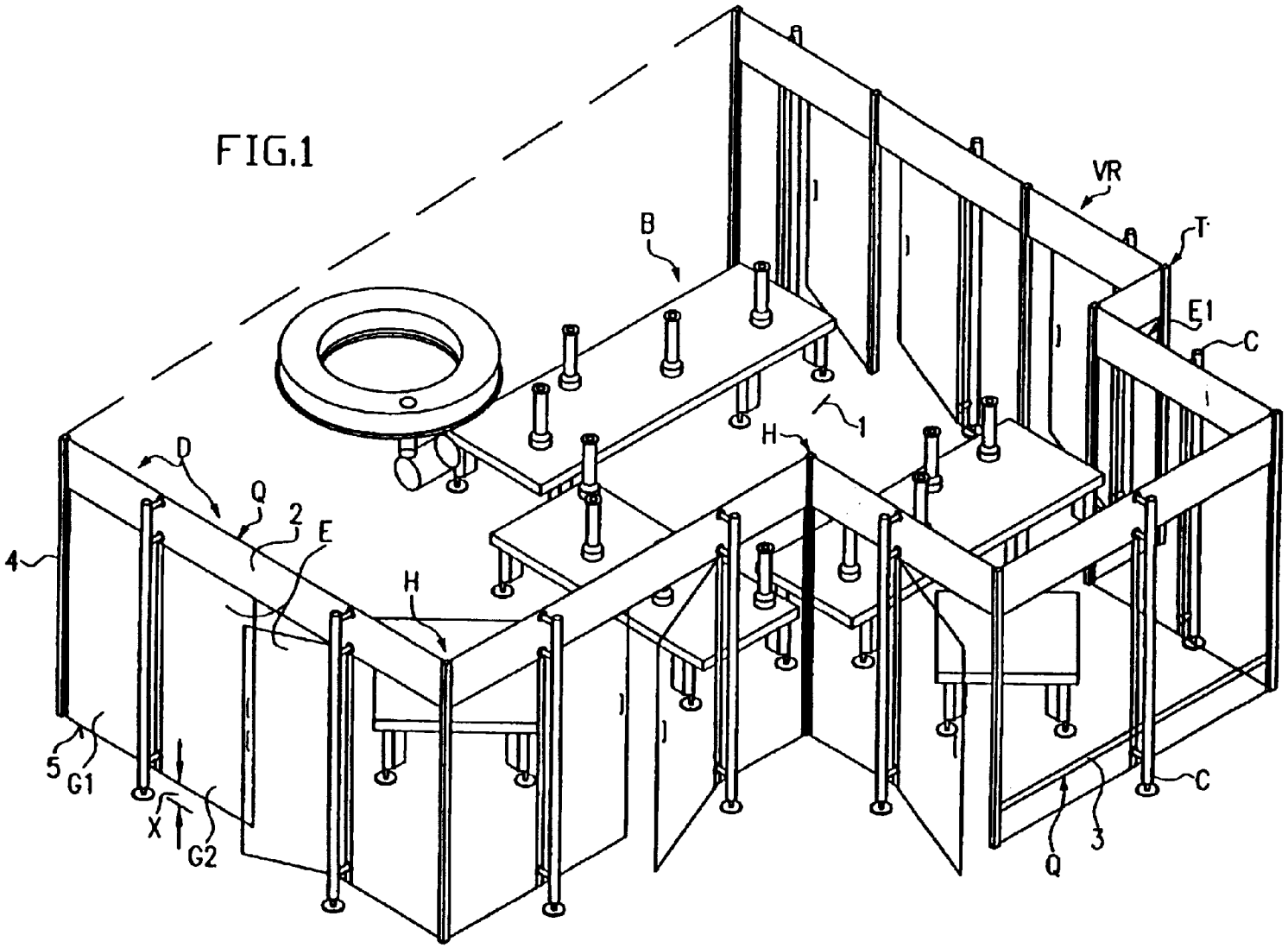
FIG. 1 is a schematic perspective view of a treatment or manufacturing installation in a working area, which comprises a machine protection device which performs a dual function.

FIG. 1 illustrates a treatment or manufacturing installation, which is surrounded at least on a plurality of sides by a supporting frame T, in a working area, which comprises a machine B which has at least one work station, where only the basic machine components are shown for the sake of simplicity. The supporting frame T, which comprises a plurality of areas D, stands with its vertical pillars C on a floor area 1 and is matched to the floor area contour of the machine B at a distance therefrom. In the embodiment illustrated, what are substantially right angles H are formed between the rectilinearly aligned areas D, of which there may be a plurality depending on the particular situation. The vertical pillars C are additionally connected to each other via transverse connections Q, wherein a continuous strip-like screen 2, e.g. one made of stainless steel sheet, is attached to the vertical pillars C at the top and forms the upper boundary of the supporting frame T. The supporting frame T advantageously ends freely above the height of the work-stations provided in the machine B. Panes E are provided in areas D, and in the embodiment shown these panes are two types of frameless safety glass panes G1, G2. Safety glass panes G1 are fixedly anchored to supporting pillars C. In contrast, safety glass panes G2 are anchored so that they can swivel, wherein either a single swiveling safety glass pane G2 forms a door and fills an area D, or two safety glass panes G2 which can swivel in opposite directions jointly fill area D. In one possible variant, which is not shown, a fixedly anchored safety glass pane G1 is provided together with a swiveling, anchored safety glass pane G2 in an area D. In areas D which comprise fixedly anchored safety glass panes G1, additional lower transverse supports 3 are advantageously provided between vertical pillars C and/or between a vertical pillar C and a vertical corner fitting section 4. The lower pane edges 5 are situated at a distance X above the floor area 1, and form free drip-off edges.

The supporting frame T is autonomously stable, firstly due to the angles H and secondly due to the transverse connections Q (the screen 2 and the transverse struts 3).

If an inlet or outlet passage is required in an area D, as indicated for a feeder or an outlet device 6 for example, a stainless steel sheet panel E1 is then anchored there instead of a safety glass pane.

The supporting frame T with the safety glass panes G1, G2 forms a combined machine protection device and clean room screen VR for the machine B, or for an installation comprising a plurality of machines B, inside the supporting frame T. The supporting frame T can be closed or can be fitted to a wall inside the working area.

Clean room air-conditioning fittings, which are not shown in FIG. 1, can be disposed on the screen 2, for example, and can close off the clean room screen VR at the top in the manner of a ceiling. Purified air can also be introduced, or waste air can be discharged, below the pane edges 5.

Figures 2, 3:
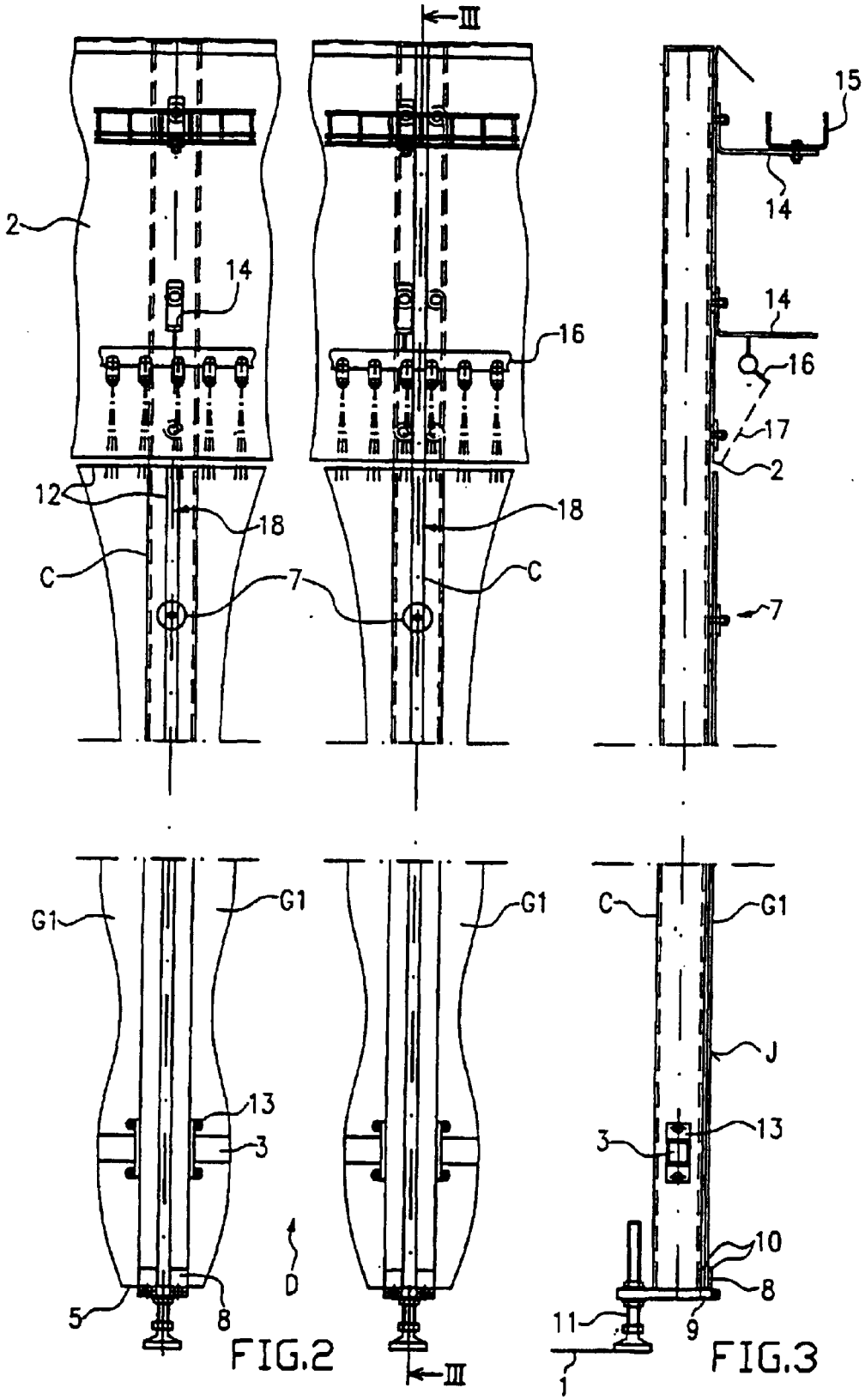
FIG. 2 is a front view of an area of the machine protection device comprising fixedly anchored safety glass panes.
FIG. 3 is a section along plane III—III of FIG. 2.

Three mutually adjoining areas D comprising fixedly anchored safety glass panes G1 are shown in detail in FIGS. 2 and 3. Each two safety glass panes G1 which abut each other with their vertical pane edges 12 are anchored to the vertical pillars C by clamping fittings 7 so that a narrow gap 18 remains. The lower pane edges 5 are seated in pane edge contact supports 8 on the vertical pillars C. Each pane edge contact support 8 has a stop pin 9 which extends transversely to the pane edge and from which small inner and outer holding brackets 10 extend, which fit over the sides of the panes from the pane edge. In this manner, the safety glass panes G1 are positioned at a distance from the inner faces of the vertical pillars C which face the machine B.

Each vertical pillar C has a height-adjustable standing foot 11 which is offset to the front in relation to the longitudinal axis of the vertical pillar C, so that the drip-off region under the pane edges 5 remains free on the floor area 1.

With this type of anchoring of the safety glass panes G, the inner faces J are freely accessible as far as the pane edges 12, 5, and due to the gaps which are provided the pane edges 12, 5 are also freely accessible, apart from the clamping fittings 7 and contact supports 8, which do not define any points which are appreciably susceptible to soiling, however.

The transverse struts 3 are fixed to the vertical pillars C by flanges 13. At the top ends of the vertical pillars C, the screen 2 is fixed to the adjacent pane edge 12 with a small gap, and ends with a small drip-off lug 2 in its lower edge region. Mountings 14 for other fittings, e.g. ducts 15 for cables, tubing and the like, are provided on the screen 2, as is a disinfectant spraying device 16, the spraying direction of which is oriented obliquely downwards in relation to the safety glass panes G1, G2.

Figures 4, 5:
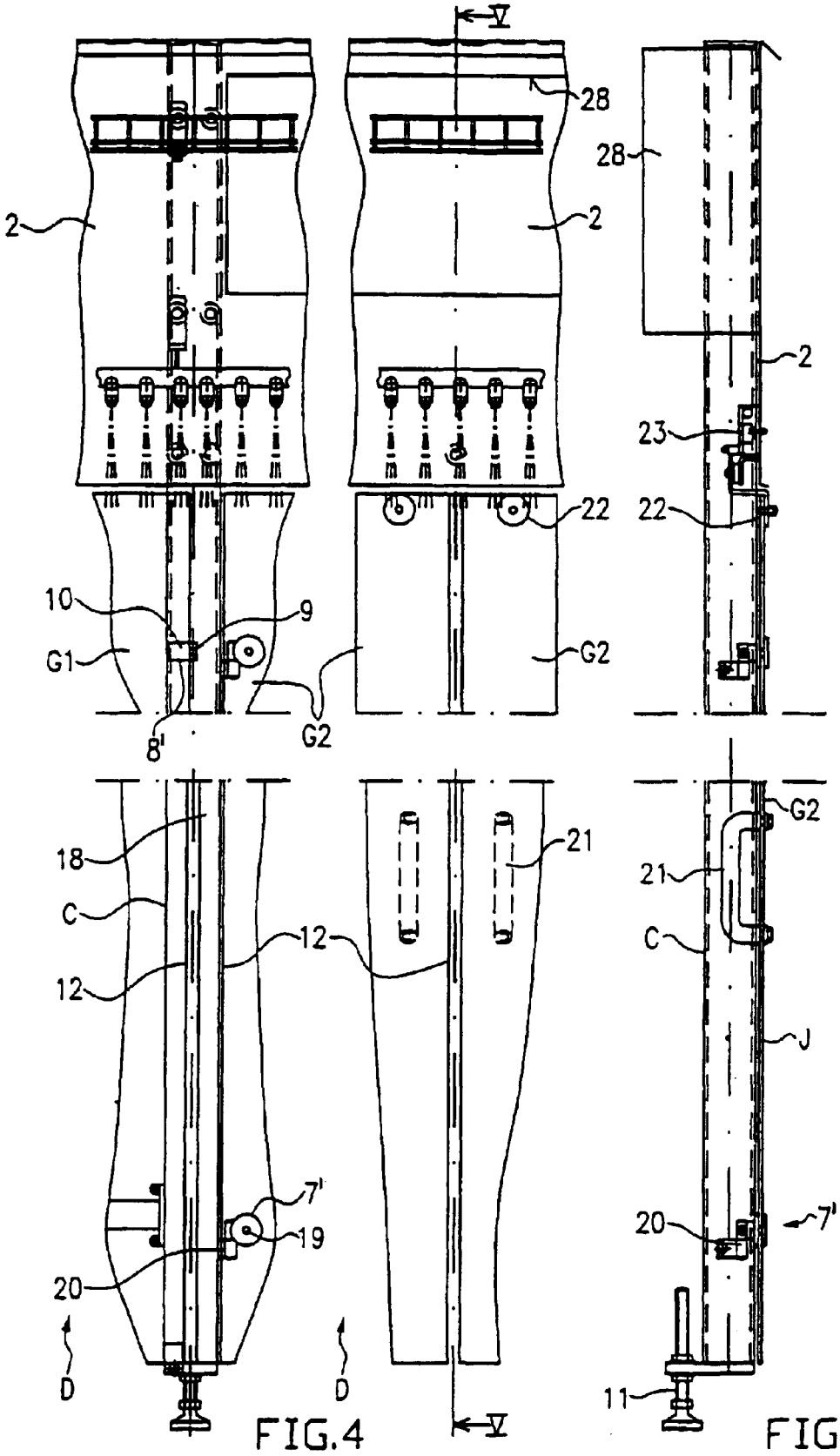
FIG. 4 shows part of an area comprising safety glass panes which can be swivelled, as a view of the machine protection device from the inside.
FIG. 5 is a section along plane V—V of FIG. 4.

The transition from an area D with a fixedly anchored safety glass pane G1 to an area with two safety glass panes G2 which are anchored so that they can swivel is shown as a front view and as a sectional view in FIGS. 4 and 5. Since it is only the right-hand vertical pane edge 12 of the safety glass pane G1 which has to be fixed here to the vertical pillar C, a contact support 8 comprising horizontal holding brackets 10 and a stop pin 9 is provided here instead of at least one double clamping fitting 7 in each case. A wider gap 18 is left here between the fixedly anchored safety glass pane G1 and the swivel-anchored safety glass pane G2. The safety glass pane G2 is anchored to the vertical pillar C, at at least two points situated one above the other, by clamping fittings 7' and via hinge fittings 20. The clamping fittings 7' have pins 19 which are inserted in holes in the safety glass pane G2 which are not shown. The second swivel-anchored safety glass pane G2, which is similarly anchored to the following vertical pillar C, is also provided in this area. The two safety glass panes G2 are situated with their vertical pane edges facing each other with the formation of a narrow gap 18. Handles 21 serve for opening and closing the safety glass panes G2. Moreover, actuators 22 for electric door switches 23 are provided on the swivelling safety glass panes G2. The door switches 23 themselves are mounted on the outside of the screen 2, and are employed, for example, for correspondingly controlling display or safety devices. Furthermore, in FIG. 5 a housing 28 for electrical fitting components is provided in the screen 2, facing the outside thereof; said housing can also extend over the entire height of the vertical pillars C and can replace a glass plane G1, G2 or a sheet metal panel E1.

Figure 6:
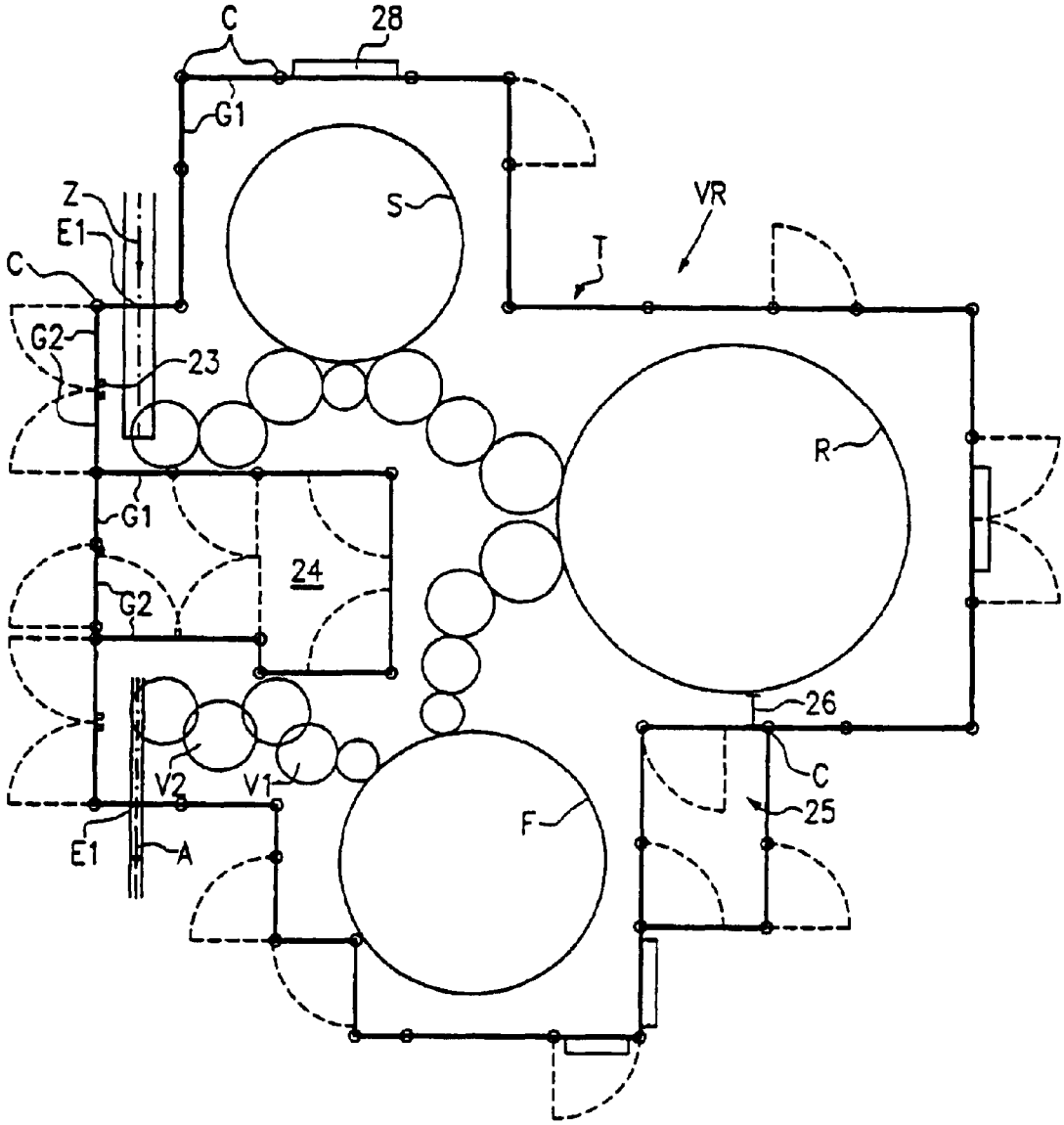
FIG. 6 is a schematic plan view of the treatment or manufacturing installation in a working area.

FIG. 6 shows a combined machine protection device and clean room screen VR, the supporting frame T of which is matched, with an intermediate gap, to the floor area contour of the installation, which consists of a plurality of machines S, R, F, V1, V2. Depending on the requirements, fixedly anchored or swivel-anchored safety glass panes G1, G2 are provided in the areas defined by the vertical pillars C. In regions which necessitate access, for a feed line and an outlet line, for example, sheet metal panels E1 are inserted in the corresponding areas D. As is indicated in principle by the swivelling regions shown as dashed lines, there is a plurality of possible entrances to the interior of the clean room area. An externally and internally separated chamber 24 is defined within the course of the supporting frame T by areas which are correspondingly disposed in a rectangle. This chamber can be entered without reaching the installation directly, but there are also various options for proceeding further from the chamber in order to arrive directly at the installation. Accordingly, a plurality of swivel-anchored safety glass panes G2 is disposed there. Moreover, a lock 25 is incorporated in the supporting frame T, via which access to other machines of the installation is possible. Reference numeral 26 denotes a spacer between a vertical pillar C and a machine table or machine.

The installation which is accommodated in the clean room area in FIG. 6 may be a beverage bottle treatment installation for sterile filling, for example. Empty bottles enter the clean room area via the feeder Z. Product lines are also run into the clean room area there. Machine S is a steriliser for sterilising the bottles. The bottles are transferred to the steriliser by a corresponding feeder star (indicated as circles). Machine R is a rinser which rinses the bottles. Machine F is a filler F which introduces the product before the bottles are subsequently closed by a closer V1 or V2 and are conveyed away via the outlet A.

Figure 7:
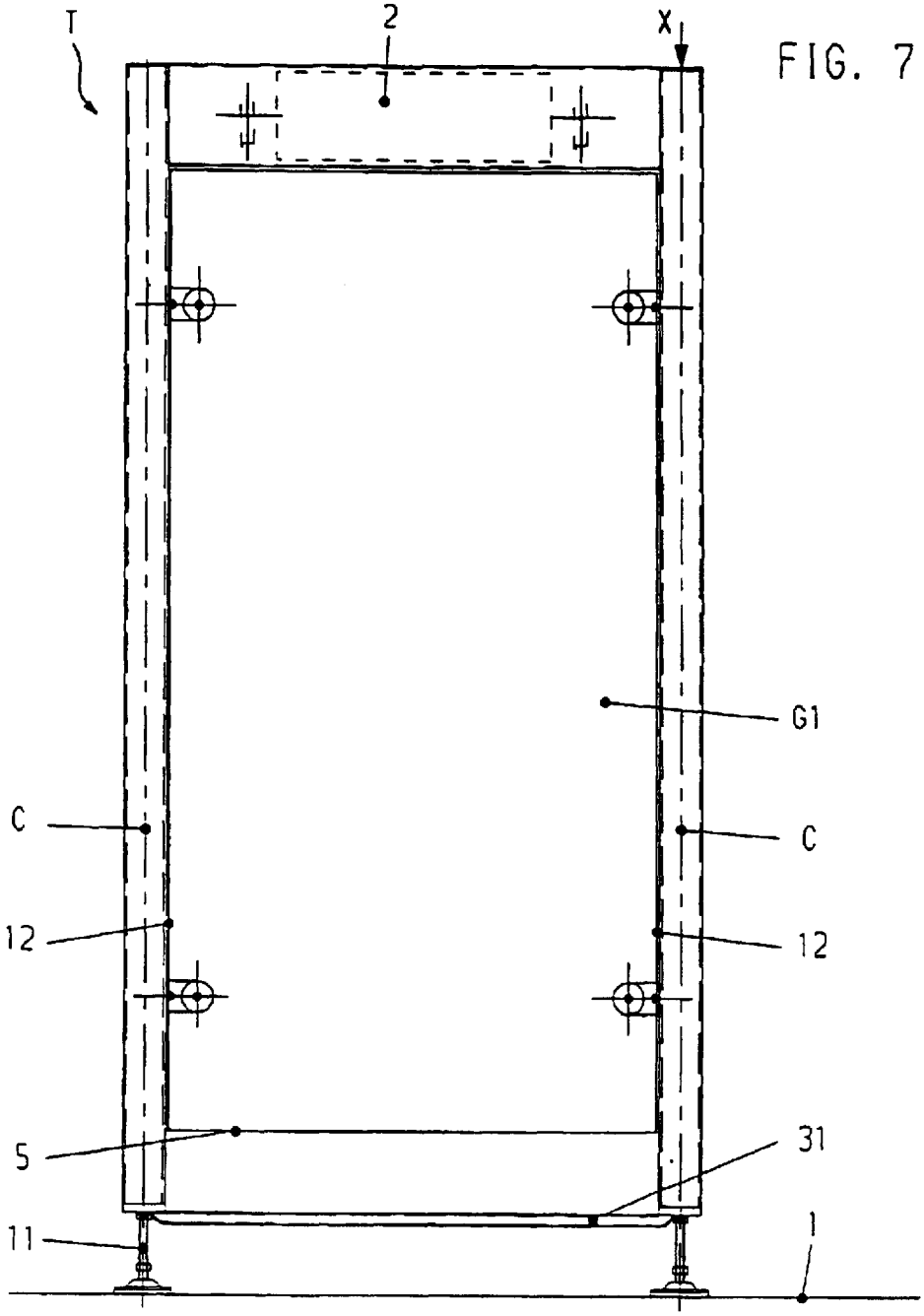
FIG. 7 is a front view of an area of another embodiment of the machine protection device comprising fixedly anchored safety glass panes.
Figure 8:
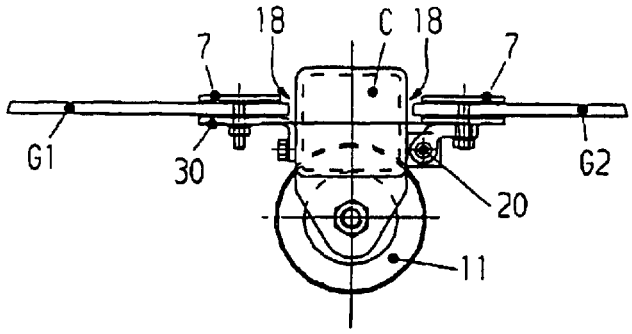
FIG. 8 is view X as indicated in FIG. 7.

The machine protection device shown in FIGS. 7 and 8 differs from the machine protection device shown in FIGS. 1 to 5 in that here both the rigid glass panes G1 and the swivelling glass panes G2 are disposed on the sides of the vertical pillars C and are therefore situated between two adjacent vertical pillars C. Accordingly, the gaps 18 are formed here between the vertical pane edge 12 and the adjacent outer face of the respective vertical pillar C. This form of construction is also easy to clean and is therefore very suitable for screening a clean room.

As shown in FIG. 8, sheet metal angles 30, to which the rigid glass panes G1 are fixed by means of clamping fittings, are fixed to the sides of the vertical pillars C. Hinge fittings 20, to which the swivelling glass panes G2 are fixed by means of clamping fittings 7, are correspondingly fixed to the sides of the vertical pillars C.

In the embodiment shown in FIGS. 7 and 8, the transverse connections Q are formed by tubular sections 31 which are fixed to the undersides of the vertical pillars C.

What is claimed is:

1. A treatment or manufacturing installation in a working area as a machine protection device for a machine having at least one workstation which is fixedly disposed on a floor area, comprising:

panes which cover at least the workstation, a supporting frame for the panes having frame areas which comprises vertical pillars, the supporting frame (T) standing with the vertical pillars (C) on the floor area (1) and matched to the contour of the machine (B) on the floor area, in an autonomously stable manner, with an angle (H) between adjacent frame areas (D) and transverse connections (2) between the vertical pillars (C), with an immediate spacing to the floor area contour of the machine (B), and the panes (E) being frameless safety glass panes (G1, G2), with each pane anchored at a distance (X) above the floor area (1) to at least one of the vertical pillars (C), and the inner faces (J) of the panes (E) which face the machine (B) being freely accessible from the machine (B) side as far as the pane edges (5, 12).

2. An installation according to claim 1, wherein for each frame area (D) a frameless safety glass pane (G1) which is continuous in a transverse and vertical direction is fixedly anchored.

3. An installation according to claim 1, wherein open gaps (18) are provided between adjacent vertical pane edges (12).

4. An installation according to claim 1, and strip-like sheet metal screens (2) join the vertical pillars as the transverse connections (Q) above the panes on the inner faces of the vertical pillars (C).

5. An installation according to claim 4, wherein one of internal and external mountings (14, 15) are provided on the screens (2).

6. An installation according to claim 5, wherein the mountings are adapted to fit one of cables, leads, tubing, fluid outflow devices, and electrical components.

7. An installation according to claim 1, wherein each vertical pillar (C) has a height-adjustable standing foot (11) which is outwardly offset in relation to the longitudinal axis of the vertical pillar, beyond the front face of the vertical pillar.

8. An installation according to claim 1, wherein lower transverse struts (3) are inserted between the vertical pillars (C) in frame areas (D) which comprise fixedly anchored panes.

9. An installation according to claim 1, wherein pane edge clamping fittings (7) and pane edge contact supports (8) are provided on the vertical pillars (C) in frame areas (D) which comprise fixedly anchored safety glass panes (G1).

10. An installation according to claim 9, wherein the pane edge contact supports (B) each comprise a pin (9) which is oriented transversely to the plane of the pane, and internal and external holding brackets (10) which act inwardly from the pane edge (5, 12).

11. An installation according to claim 1, and areas comprising a passageway for inflow or outflow devices (Z, A) are provided in the supporting frame (T), and that at least one sheet metal panel (E1) is anchored to the vertical pillars (C) in the region of the passageway.

12. An installation according to claim 1, wherein spacers (27) are provided between individual vertical pillars (C) and the machine (B).

13. An installation according to claim 1, wherein the supporting frame (T) is constructed in a modular form of construction with areas (D) of one of variable or identical area widths which are one of substantially at right angles (H) to each other or which are rectilinearly aligned with each other.

14. An installation according to claim 1, wherein the safety glass panes (G1, G2) are disposed at a distance in front of the inner faces of the vertical pillars (C).

15. An installation according to claim 1, wherein the machine is one of a beverage bottle treatment machine or a beverage bottle manufacturing machine.

16. An installation according to claim 1, and wherein the machine protection device provides a clean room boundary about the machine having a workstation.

17. An installation according to claim 1, wherein for each frame area (D) one of one or two frameless safety glass panes (G2) are continuous in a vertical direction and anchored so as to swivel.

18. An installation according to claim 17, and rotary clamping fittings (7') comprising retaining pins (19) which pass through holes in the panes are provided on the vertical pillars (C) in frame areas (D) which comprise a swiveling safety glass panes (G1).

19. A machine protection device comprising a supporting frame having transparent panes and vertical pillars, the panes being frameless safety glass panes (G1, G2) and one of anchored fixedly or anchored so that they can swivel relative to the vertical pillars (C), the vertical pillars standing directly on the floor area (1) separate from the machine (B), the panes being at a distance behind the vertical pillars and at a distance above the floor area (1), the supporting frame being free at the top and autonomously stable due to angles (H) and transverse connections (Q) formed in the course between frame areas (D), and the inner faces (J) of the safety glass panes (G1, G2) which face the machine (B) being freely accessible as far as the pane edges (12, 15).

20. A machine protection device according to claim 19 wherein the supporting frame (T) and safety glass panes (G1, G2) are formed to define a clean room boundary about the machine (B).

* * * * *